US007096706B2

(12) United States Patent
Klingen et al.

(10) Patent No.: US 7,096,706 B2
(45) Date of Patent: Aug. 29, 2006

(54) DRAWING APPARATUS AND METHOD OF OPERATING SAME

(75) Inventors: Hermann-Josef Klingen, Moers (DE); Thomas Winterfeldt, Rheinberg (DE); Norbert Zillekens, Hückelhoven (DE)

(73) Assignee: SMS Meer GmbH, Monchengladbach (DE)

( * ) Notice: Subject to any disclaimer, the term of this patent is extended or adjusted under 35 U.S.C. 154(b) by 19 days.

(21) Appl. No.: 10/932,876

(22) Filed: Sep. 2, 2004

(65) Prior Publication Data

US 2005/0050933 A1 Mar. 10, 2005

(30) Foreign Application Priority Data

Sep. 10, 2003 (DE) ..... 103 41 726

(51) Int. Cl.
*B21C 1/20* (2006.01)
*B21C 1/27* (2006.01)

(52) U.S. Cl. ..... 72/275; 72/291

(58) Field of Classification Search ..... 72/275, 72/287, 291, 290
See application file for complete search history.

(56) References Cited

U.S. PATENT DOCUMENTS 4,127,999 A * 12/1978 Lorenz ..... 72/290
4,291,565 A * 9/1981 Saunders ..... 72/290

FOREIGN PATENT DOCUMENTS

| | | |
|---|---|---|
| DE | 1 946 194 | 3/1971 |
| DE | 80 421 | 3/1971 |
| DE | 1 256 393 A2 | 11/2002 |
| DE | 1 256 393 A3 | 11/2002 |
| DE | 1 262 249 A2 | 12/2002 |
| EP | 0 548 723 B2 | 6/1993 |
| EP | 0 596 577 | 5/1994 |
| FR | 717073 | 12/1931 |
| FR | 0 814 921 B1 | 1/1998 |
| GB | 1 481 833 | 8/1974 |

* cited by examiner

*Primary Examiner*—Daniel C. Crane
(74) *Attorney, Agent, or Firm*—Andrew Wilford

(57) ABSTRACT

A single carriage of the drawing apparatus for pulling a continuous metal workpiece through a drawing die is displaceable back and forth by a linear electronic motor drive. A coil forms a supply upstream of the die which can pay off a length of the workpiece to form a loop adapted to be drawn through the die without tensioning it against the coil.

8 Claims, 1 Drawing Sheet

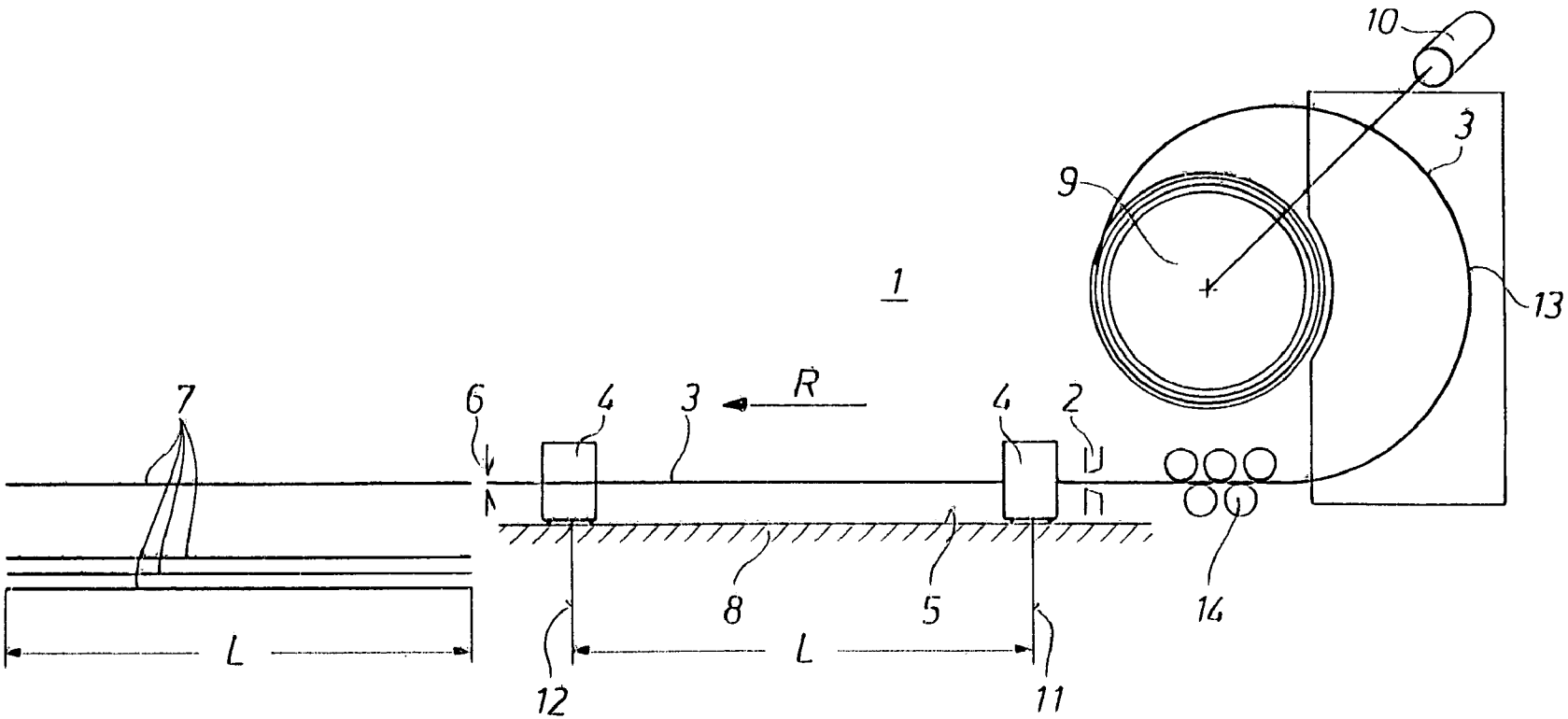
13
3
10
9
14
2
4
11
5
1
R
L
8
3
4
12
6
7
L

DRAWING APPARATUS AND METHOD OF OPERATING SAME

FIELD OF THE INVENTION

The present invention relates to drawing apparatus, especially for the shaping of a bar, tube and rod stock of metal in the production of shaped bars, tubing and semi-finished products. More particularly, the invention relates to a drawing apparatus in which a substantially continuous workpiece is drawn through a die and lengths of the drawn product are cut from the workpiece downstream of the die. The invention also relates to a method of operating a drawing apparatus for this purpose.

BACKGROUND OF THE INVENTION

In the shaping of bar, tube and rod stock of metal, especially steel and nonferris metals, a drawing device can be used in which a carriage engages the workpiece downstream of a die and displaceable to pull the workpiece through the die. The finished products which result have precise dimensions and a good finish and can be bars of various configuration, tubes and wire or rod with precise external dimensions. The die or drawing ring is generally stationary and downstream of the die a cutoff device can be provided for cutting the drawn product into desired lengths.

Drawing apparatus of the afore-described type, as hitherto provided, can be divided into two groups. One group encompasses drum-type drawing machines while the other encompasses linear drawing machines.

In the category of linear drawing machines, it is known to provide two counter movable drawing carriages, one of which is displaceable in a direction away from the die while engaging the workpiece to pull the workpiece through the die while the other returns from its maximum excursion position to a location close to the die so as to be ready to engage the workpiece. The workpiece is pulled through the die, therefore, by a hand over hand action.

In another arrangement, two countermoving circulating endless drawing chains are provided which can be coupled with and decoupled from the workpiece.

Such drawing machines, often referred to as caterpillar or track drawing machines are described for example in European documents EP 0 548 723 B2 and EP 0 814 921 B1.

They have, by comparison to the hand over hand type of drawing machine the advantage that the endless chains can move more uniformly and in one direction and thus do not need to intermittently accelerate a mass with the detrimental effect that that may have on an apparatus.

In the finishing stages of the fabrication of tubes, structural shapes and semifinished bar products of steel and nonferris metal products, there are various advantages it providing a drawing bench or the like for drawing the workpiece and then cutting it to specific lengths. The two-slide or two-carriage machines require either flying cutoff devices or like systems in which over a length of from 4 to 6 meters, a cutoff tool may have to be moved along with the workpiece.

The linear drawing benches of the prior art, in addition, generally allow only a limited stroke of the alternatingly moving carriages and thus multiple strokes for a given finished length of the drawn product. This is the case with hand over hand operation as has been described. The processing is generally discontinuous and the machine must therefore be capable of withstanding high inertias.

Another drawback of earlier drawing benches is that they are relatively prone to failure, have high maintenance and repair cost and have lower productivities than may be desirable. The flying saw or other cutoff devices is comparatively expensive and contributes to the high operating, maintenance and capital cost.

OBJECTS OF THE INVENTION

It is, therefore, the principal object of the present invention to provide an improved drawing apparatus or bench of the linear pull type whereby the aforementioned drawbacks are avoided.

It is also an object of the invention to provide an improved drawing bench which can simplify the cutoff of lengths of the drawn product.

Still another object of the invention is to provide an improved method of operating a drawing apparatus.

SUMMARY OF THE INVENTION

These objects and others are attained, in accordance with the invention, in a drawing apparatus or bench for shaping an elongated workpiece especially bar, tubing, semifinished stock of steel or nonferrous metal (e.g. aluminum, copper or brass) which comprises:

a drawing die through which an elongated continuous metal workpiece extends;

a supply of the elongated continuous metal workpiece upstream of the die;

a drawing carriage downstream of the die and engageable with the workpiece on a downstream side of the die, the drawing carriage being the sole carriage engageable with the workpiece for drawing the workpiece through the die and being displaceable along a linear path downstream of the die;

a linear drive for the carriage for displacing the carriage along the path through a distance at least equal to a predetermined length of a drawn product to be produced away from the die and back toward the die; and a cutter downstream of the path for cutting the drawn product into pieces of that length.

The method can comprise the steps of:

(a) engaging the workpiece with the carriage at a starting position proximal to the die;

(b) displacing the carriage away from the starting position along the path with the linear drive to an end position distal from the die, thereby drawing the workpiece through the die and producing a segment of the drawn product;

(c) disengaging the workpiece from the carriage at the end position;

(d) returning the carriage with the linear drive to the starting position;

(e) re-engaging the workpiece with the carriage at the starting position; and (f) repeating steps (b) through (e) to produce further segments of the drawn product.

According to the invention, therefore, from an apparatus point of view, only a single drawing carriage or slide is provide which is displaceable along a linear path. As a consequence, an intermittent or discontinuous operation is possible which has significant advantages as will be developed below.

In a preferred embodiment configuration of the invention the linear drive operates in accordance with the principals of a linear electric motor. The linear drive allows in a single stroke the displacement of the workpiece through the die corresponding to at least the largest dimension of the length of the workpiece to be cut from the drawing product. Advantageously, the cutoff device is fixed in position relative to the die.

Upstream of the die with respect to the drawing direction, the supply can include a coil of the workpiece which itself can be driven to payoff at least the length of the workpiece before pulling commences, which is equal to a length of the stroke of the linear motor and the length which is cutoff from the drawn product. The coil drive can be controllable or regulatable for that purpose.

With respect to the method, the spacing between the starting position and the and position can correspond to the desired length of the drawn product which is cut off and the cutoff can occur during step (c) and or step (d) and or step (e). The payoff of a length of workpiece from the coil as described, e.g. in the form of a compensating arc of the workpiece, can occur also during the step (c) and or step (d) and or step (e).

With the system of the invention and the method of its operation, a variety of advantages are obtained. Firstly, the drawing speed of the carriage or slide can be significantly higher than with prior art systems. The increased drawing speed can provide an increase in the productivity and capacity of the apparatus which, of course, brings significant cost advantages.

Drawing benches which operate with linear drives utilizing the linear electric motor principle, i.e. are linear electric motors, enable a substantially greater stroke between the start and end positions then is obtainable with conventional drawing benches. For example, a stroke of about 3 meters can be obtained and even greater strokes where required. The discontinuous operation need only use a single drawing slide or carriage and thus limits the inertias which must be braked or accelerated. The stroke can be matched to the maximum length of the drawn product which can be cut from the workpiece so that only a single stroke is required for each cut length.

The drawn product can be at stand still during the cutoff phase and the return stroke of the carriage. The discontinuous drawing permits a stationary cutoff device to be used since there is sufficient time during the return stroke to effect the cutoff. Expenses for displacing the cutoff device can be eliminated.

The construction of the drawing bench and its reliability, simplicity of maintenance and ease of operation are all significant advantages. The linear drive permits the carriage to be accelerated in very short periods to the requisite drawing velocity and thus the cost is minimized.

BRIEF DESCRIPTION OF THE DRAWING

The sole FIGURE of the drawing is a diagrammatic side elevational view illustrating the apparatus of the invention.

SPECIFIC DESCRIPTION

In the FIGURE, a drawing apparatus or bench 1 has been illustrated which may constitute the finishing region of a processor for endless metal workpieces. The drawing bench 1 comprises a drawing die 2 through which the workpiece 3 is pulled in a drawing direction R.

The workpiece 3 is supplied from a coil 9 which has an unwinding device and controller 10 which can be electrically driven, for example, so that an arc 13 of the desired length can be unwound upstream of the die 2 and provide a length at least equal to the length L of segments 7 to be cut from the workpiece 3 before the workpiece 3 pulls against the coil 9. The arc 13 of the workpiece 3 functions as a bank which can be drawn without retardation from the coil 9.

The workpiece 3 drawn from the coil 9 initially passes through a set of rollers 14 forming a leveler or straightener upstream of the die 2. In the drawing direction R downstream of the die 2, a single drawing carriage 4 is provided which can slide on a linear path or track 5 between a starting position 11 and an end position 12. A linear electronic motor 8 serves to reversibly drive the slide 4.

Using the drawing apparatus 1, the segments 7 of the workpiece are drawn through the die 2 with each stroke of a length L and passed through a stationary cutoff unit 6 which can be a saw.

Initially the carriage 4 in the starting position 11 engages the workpiece 3 with a gripper (not shown) and pulls the workpiece 3 through the die 2 over the length L to the end position 12. In this position, the segment 7 has been passed through the cutter 6 so that if the carriage 4 returns to the starting position, the length L is cut from the continuous workpiece 3 to permit return of the carriage 4, after its gripper releases the workpiece 3. The linear drive 8 is reversible for this purpose as noted.

Repetition of the process allows the desired number of lengths 7 to be cut off.

The period between release of the workpieces 3 by the carriage 4 and its return to the starting position 11 is sufficient time to effect the cutoff so that a stationary cutter 6 can be used.

To permit high drawing speeds to be obtained, it is important that during the return of the carriage 4, the controller 10 advance the workpiece 3 to form the loop 13 of the workpiece 3 at the supply 9 sufficient to allow the length L to be pulled through without tensioning of the workpiece 3 against the coil 9.

We claim:

1. A drawing apparatus for shaping an elongated continuous metal workpiece wound into a coil, the apparatus comprising:

a drawing die;

means upstream in a direction from the die for unwinding the elongated continuous metal workpiece from the coil and feeding it in the direction through the die;

a drawing carriage downstream of said die and engageable with said workpiece on a downstream side of said die, said drawing carriage being the sole carriage engageable with said workpiece for drawing said workpiece through said die and being displaceable along a linear path downstream of said die;

a linear electric motor for said carriage for displacing said carriage along said path through a distance at least equal to a predetermined length of a drawn product to be produced away from said die and back toward said die; and a cutter downstream of said path for cutting said drawn product into pieces of said length.

2. The drawing apparatus defined in claim 1 wherein said linear electric motor has a linear displacement (L) corresponding at least to a maximum value of the length of the drawn product to be produced by the apparatus.

3. The drawing apparatus defined in claim 1 wherein said cutter is located at a fixed distance from said die.

4. The drawing apparatus defined in claim 1, further comprising a control for means for unwinding for regulating a speed with which said workpiece is unwound from said coil.

5. The drawing apparatus defined in claim 1 wherein said die and said carriage are configured for the drawing of bar, tube or semifinished stock.

6. A method of operating a drawing apparatus for shaping an elongated continuous metal workpiece and which comprises a drawing die, a coil of said elongated continuous metal workpiece upstream in a direction of said die, a drawing carriage downstream of said die and engageable with said workpiece on a downstream side of said die, said drawing carriage being the sole carriage engageable with said workpiece downstream of the die and being displaceable along a linear path downstream of said die, a linear electric motor for said carriage for displacing said carriage along said path through a distance at least equal to a predetermined length of a drawn product to be produced away from said die and back toward said die, and a cutter downstream of said path, said method comprising the steps of:

(a) unwinding the workpiece from the coil and feeding it in the direction through the die;

(a') engaging said workpiece with said carriage at a starting position proximal and downstream to said die;

(b) displacing said carriage downstream away from said starting position along said path with said linear electric motor to an end position distal from said die, thereby drawing said workpiece through said die and producing a segment of the drawn product;

(c) disengaging said workpiece from said carriage at the end position;

(d) returning said carriage with said linear electric motor to said starting position;

(e) re-engaging said workpiece with said carriage at said starting position;

(f) cutting said drawn product downstream of said path; and (g) repeating steps (b) through (f) to produce further segments of the drawn product.

7. The method defined in claim 6 wherein a distance (L) between the starting position and the end position corresponds to a length (L) of a desired drawn product segment.

8. The method defined in claim 7 wherein said supply is a coil of said workpiece, said method comprising unwinding from said coil a length of said workpiece at least equal to the length (L) of the drawn product segment during at least one of steps (c), (d) and (e).

* * * * *